United States Patent [19]

Beckley

[11] Patent Number: 4,523,854

[45] Date of Patent: Jun. 18, 1985

[54] APPARATUS FOR MIXING FOUNTAIN SOLUTION

[75] Inventor: Robert A. Beckley, Mount Vernon, Ill.

[73] Assignee: World Color Press, Inc., Effingham, Ill.

[21] Appl. No.: 549,315

[22] Filed: Nov. 7, 1983

[51] Int. Cl.[3] ..... B01F 15/02

[52] U.S. Cl. ..... 366/132; 101/147; 366/134; 366/142; 366/152; 366/153; 366/160; 366/166; 366/177; 366/189; 366/190

[58] Field of Search ..... 366/132, 134, 136, 137, 366/142, 151–153, 159–161, 163, 165, 166, 173, 176, 177, 167, 182, 190–192, 262, 189; 101/147, 148; 137/91, 93, 88; 222/64; 210/96.1, 104, 149

[56] References Cited

U.S. PATENT DOCUMENTS

| | | | |
|---|---|---|---|
| 3,877,682 | 4/1975 | Moss | 366/153 X |
| 3,947,356 | 3/1976 | Werhli | 101/147 X |
| 4,146,474 | 3/1979 | Kagatani | 101/147 X |
| 4,165,186 | 8/1979 | Tortorich et al. | 366/262 X |
| 4,187,029 | 2/1980 | Canale et al. | 366/153 |

*Primary Examiner*—Timothy F. Simone

*Attorney, Agent, or Firm*—Gravely, Lieder & Woodruff

[57] ABSTRACT

An apparatus for mixing the fountain solution used by lithographic printing presses includes a mixing tank and a pump unit for withdrawing the fountain solution from the tank and directing it into a distribution line that leads to several printing presses. Water for the fountain solution is supplied through a water line containing a solenoid valve. The additives, on the other hand, are pumped from drums into measuring containers located above the mixing tank, there being a separate measuring container and pump for each additive. Each measuring container has a solenoid valve at its bottom for releasing its additive into the tank when opened and a float switch for de-energizing its pump when the additive reaches a prescribed level in the measuring container. The water and additive valves, as well as the pumps, are controlled automatically, and to this end each measuring container has its own float switch, while the mixing tank contains high and low level float switches. As the pump unit for the mixing tank operates, it draws solution from the tank, and when the solution drops below the high level switch, the additive pumps are energized and supply additive to their respective measuring containers. Once the level of additive in any container reaches the float switch for that container, the additive pump stops. When the fountain solution in the mixing tank reaches the low level switch for the tank, the pump unit is de-energized and the water valve as well as the valves for the additive containers open. These valves remain open until the new solution, which is mixed in the tank, reaches the high level switch, whereupon the cycle is repeated.

13 Claims, 4 Drawing Figures

APPARATUS FOR MIXING FOUNTAIN SOLUTION

BACKGROUND OF THE INVENTION

This invention relates in general to printing and, more particularly, to an apparatus for supplying printing presses with a fountain solution.

In lithography, the printing process used in most current printing, particularly full color printing, a plate carries an etched image that is ink receptive, and the ink on this image is transferred to a surface that may be on paper or some other material, thereby imparting the image to the surface. A fountain solution, which is primarily water, settles over the blank areas of the plate and renders those areas ink-repellant. In the typical multicolor printing press the plate is normally on a rotating plate cylinder and indeed forms the cylindrical outside surface of that cylinder. The plate cylinder moves against an ink roller where it picks up both the ink and the fountain solution, the latter having been delivered to the ink roller in the ink train. The ink and fountain solution separate on the plate cylinder, the former going to the etched image on that plate and the latter to the blank areas. The plate cylinder may upon further rotation apply the coating of ink directly to the surface that is to be printed, but it usually runs against another cylinder, called a blanket cylinder, which picks up the inked image and then transfers it to the surface that is to be printed.

While the fountain solution is basically water, it does contain additives such as gum arabic to retain the water on the blank areas of the plate cylinder, an antioxidant to inhibit corrosion of the plate cylinder, antifungal agents to deter a film from developing in the fountain solution, at least during warm weather, and a release agent to prevent the paper or other material from sticking to the blanket cylinder.

Each press has a circulating tank or reservoir for holding the fountain solution, and the solution is withdrawn from the tank and introduced into the ink train, from which some of it passes onto the plate cylinder. However, much more is separated from the ink and returned to the circulating tank to cool. Of course, some of the fountain solution is lost with each revolution of the plate cylinder so the solution in the circulating tank for each press must be continually replenished. To this end the circulating tanks are provided with mechanical float-type valves to which a pressurized distribution line containing fountain solution is connected.

Systems have been developed for supplying a properly mixed fountain solution to the circulating tanks of presses automatically, but these systems are less than satisfactory. In the first place, they are quite expensive. Secondly, they operate on a metering principle, with the amount of additive that is introduced into water being determined by the electrical conductivity of the solution that is produced. This may produce misleading results where more than one chemical is added, particularly where each has some effect on the electrical conductivity of the solution. Furthermore, it is difficult to monitor the metering system, so one never knows whether or not the fountain solution has its additives proportioned correctly. Finally, a metering system, by reason of the fact that it injects the chemicals directly into a water line, sometimes back flows, notwithstanding the presence of check valves, and this may cause additives to enter the water supply for the building in which the printing operation is conducted.

SUMMARY OF THE INVENTION

One of the principal objects of the present invention is to provide an apparatus for mixing a fountain solution that has its additives precisely proportioned for lithographic printing. Another object is to provide a system of the type stated which employs batch mixing in lieu of the less precise continuous mixing. A further object is to provide a system of the type stated which will not cause additives to back flow into the water system from which it derives the water for the solution. An additional object is to provide a system of the type stated which is very durable and highly reliable. Still another object is to provide a system of the type stated which is inexpensive to manufacture and operate. These and other objects and advantages will become apparent hereinafter.

DESCRIPTION OF THE DRAWINGS

In the accompanying drawings which form part of the specification and wherein like numerals and letters refer to like parts wherever they occur

DETAILED DESCRIPTION

Figure 1:
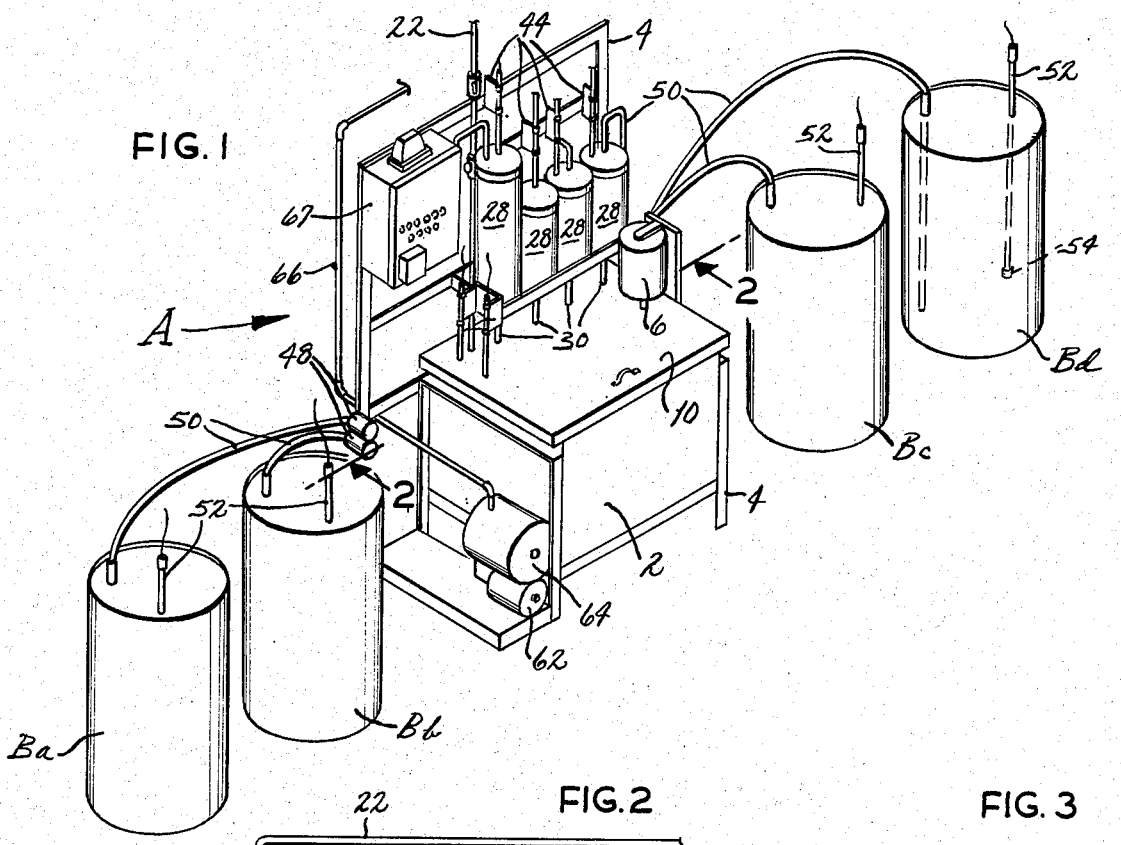
FIG. 1 is a perspective view of an apparatus constructed in accordance with and embodying the present invention.

Referring now to the drawings, a mixing apparatus A (FIG. 1) is designed to mix water and several liquid additives that are supplied separately in drums B or other containers. The additives are introduced in correct proportions to a measured volume of water and then mixed thoroughly with that water to provide a fountain solution. The apparatus A further pumps the fountain solution to the circulating tanks of several lithographic printing presses. At the presses the fountain solution is withdrawn from the circulating tanks and mixed with ink, and the resulting mixture is fed to the plate cylinders of the presses where the ink is attracted to etched images on the plate cylinders, while the fountain solution settles over the blank areas of those plate cylinders.

The typical fountain solution normally contains four additives that are derived from drums Ba, b, c, d (FIG. 1). The mixing apparatus A withdraws a measured quantity of each additive from its drum B, introduces the additive into a mixing tank 2, and further supplies a measured quantity of water to the mixing tank 2. Within the tank 2, the water and additives are thoroughly mixed to provide the fountain solution. In this connection, the tank 2 is supported on a frame 4 which also supports an electric motor 6 that turns a mixing blade 8 within the tank 2. The blade 8, when turned, imparts movement to the water within the tank 2. The frame 4 also carries a cover 10 which normally extends over the top of the tank 2 and prevents contaminants from settling or falling into the fountain solution that is within the tank 2, but the cover 10 may be lifted and removed. The tank 2 should hold at least 48 gallons and should be formed from a material which does not corrode in the presence of the fountain solution or its additives.

Figure 3:
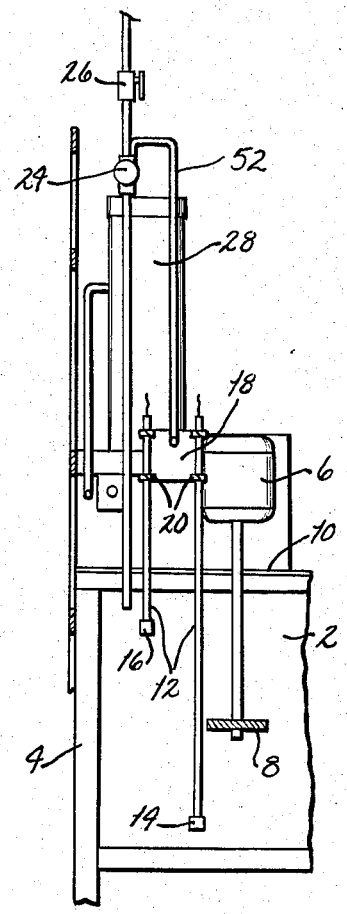
FIG. 3 is a sectional view taken along line 3—3 of FIG. 2.

The frame 4 rises above the tank 2, and at the side opposite from the motor 6 it supports two probes 12 (FIG. 3), one having a low water float switch 14 at its lower end and the other having a high water float switch 16 at its lower end. Actually, the upper ends of the two probes 12 extend through mounts 18 which are secured to the frame 4 and have thumb screws 20 which tighten down against the probes 12 and hold them in a fixed position. When the screws 20 for either probe 12 are loosened the probe 12 may be moved upwardly and downwardly, thereby changing the elevation of the float switch 14 or 16 within the tank 2.

The fresh water for the fountain solution is delivered to the tank 2 through a water supply pipe 22 (FIGS. 2 & 3) that is connected with the water supply for the building in which the mixing apparatus A and the presses which the apparatus A services are located. The supply pipe 22 contains a solenoid valve 24, which is normally closed, but when energized opens to allow water to flow from the supply pipe 20 into the tank 2. Indeed, the valve 24 is in a sense controlled by the float switches 14 and 16 on the probes 12, for the valve 24 opens when the low water switch 14 senses an empty tank 2 and does not close until the high water float switch 16 senses a full tank 2. The water supply pipe 22 also contains a manually operated shut-off valve 26.

Figure 2:
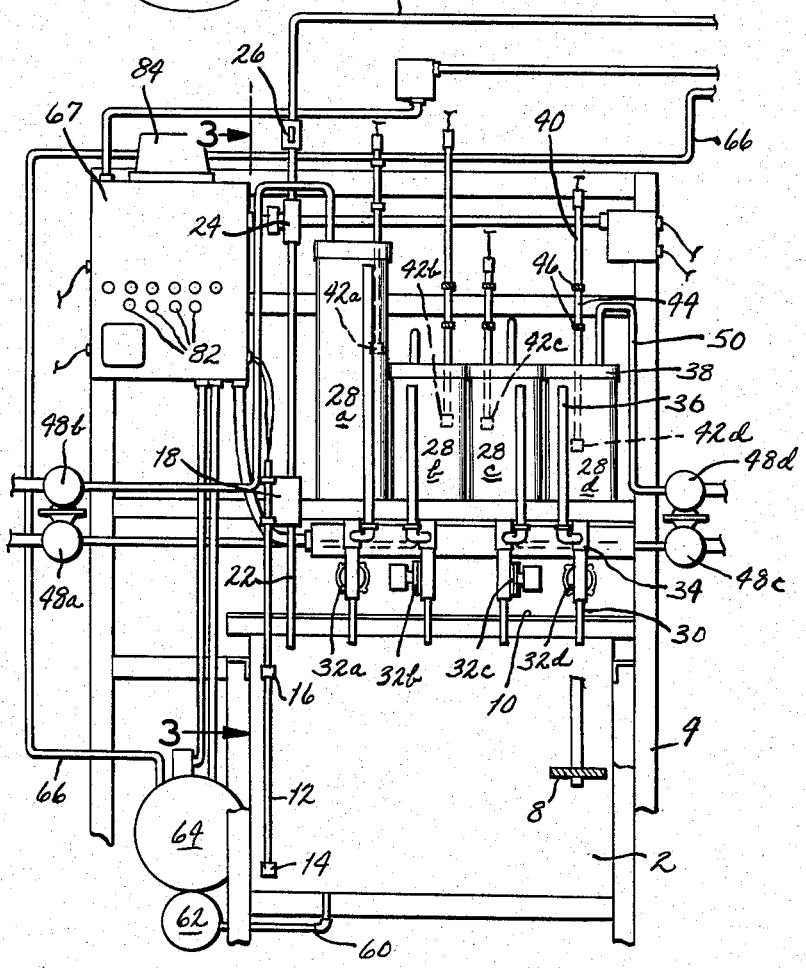
FIG. 2 is a sectional view taken along line 2—2 of FIG. 1.

The portion of the frame 4 that rises above the tank 2 extends along the back of the tank 2, and supports four measuring containers 28 *a, b, c, d*—one for each of the four additive drums B (FIG. 2). Each container 28 is formed from a material that is chemically inert insofar as the additive in the drum B with which it is associated is concerned. Each container 28 is further large enough to hold the amount of its additive that is required for the amount of water supplied to the tank 2. Extending downwardly from the bottom of each container 12 is a discharge pipe 30 that is directed into the tank 2, and the pipe 30 contains a solenoid valve 32. Normally, the valve 32 is closed to hold additive within the container 28, but when its solenoid is energized, the valve 32 opens and thereby permits whatever additive that has collected in the container 28 to flow into the tank 2. Immediately above the valve 32 the discharge pipe 30 has a T-fitting 34 to which a sight glass 36 is connected, the glass 36 projecting upwardly in front of the container 28 along calibrations which provide an indication of the volume of liquid additive in the container 28.

Each container 28 has a cover 38 through which a probe 40 (FIG. 2) extends, and the probe 40 at its lower end carries a float switch 42 that is responsive to the level of the liquid additive within the container 28. The upper portion of the probe 40 passes through a mount 44 where it is gripped and retained at thumb screws 46. When the thumb screws 46 are backed off, the probe 40 is released and may be raised or lowered to adjust the elevation of the switch 42 within its container 28.

It is the elevation of the switch 42 that determines the amount of liquid additive that the measuring container 28 receives from its drum B, for the switch 42 controls a small electrically operated pump 48 (FIG. 2) that is in a supply line 50 (FIG. 1) leading from the drum B to the container 28. Actually, the pump 48 is bolted to the side of the frame 4, and the portion of the supply line 50 that is downstream from the pump 48 is a rigid pipe, which at its end extends downwardly through the cover 38 of the container 28. The portion that is immediately upstream from the pump 38 is a hose (FIG. 1) which, being flexible, accommodates replacement of the drum B as well as changes in the position of the drum B. However, at the drum B itself the hose connects with a pipe that extends down to the bottom of the drum B.

In addition to the supply line 50, which extends into each drum B in the form of a rigid pipe, each drum B also has a probe 52 (FIG. 1) extended into it from its upper end and attached to the lower end of the probe 52 is a float switch 54 which is normally open, but closes when the level of additive approaches the bottom of the drum B.

The mixing tank 2 at its bottom has a drain pipe 60 (FIG. 2) which leads to an electrically operated pump 62, and the pump 62 in turn discharges into an accumulator or pressure tank 64. The pump 62 and tank 64 constitute a pumping unit for delivering the fountain solution at a uniform pressure to a distribution line 66 which leads to the circulating tanks of several presses, there being a separate circulating tank for each press. In this regard, the pumping unit A has its own controls and circuitry for maintaining the pressure within the pressure tank 66 and the distribution line 66 substantially constant, and the pump 62 is operated solely to restore the pressure within the tank 64. At each circulating tank is a mechanical float valve which admits fountain solution to the circulating tank to maintain the level of solution within the tank substantially constant.

The two float switches 14 and 16 and the solenoid valve 22 for the main tank 2, the solenoid valves 32 and float switches 42 for the measuring containers 28, the pumps 48 and float switches 54 for the drums B and the main pump 62 are all embodied in an electrical circuit, which further includes various control relays and warning devices. This circuit is from an electrical standpoint located between two load lines 68 and 70 and is for the most part contained within a control box 67.

Figure 4:
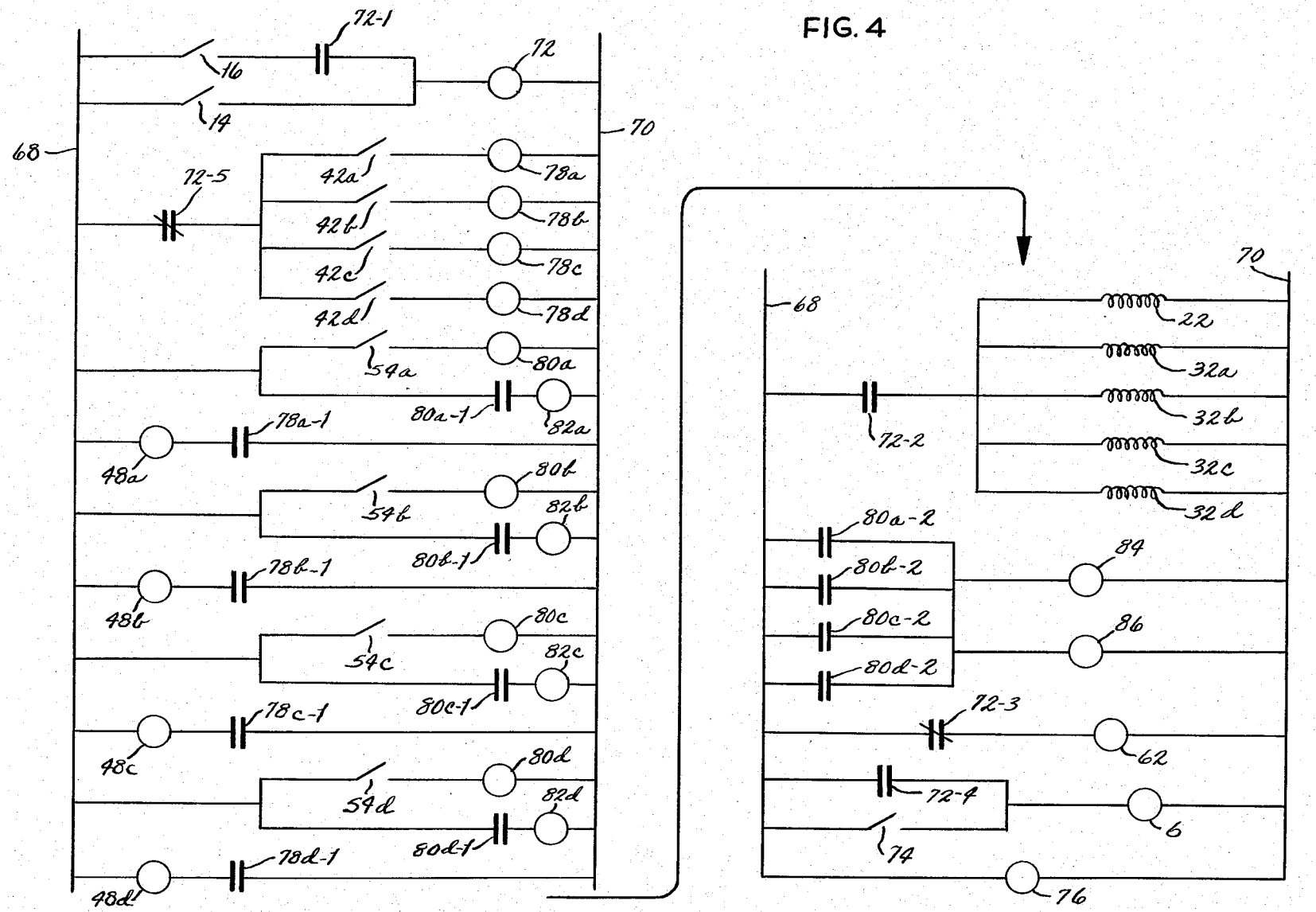
FIG. 4 is a schematic view of the electric circuit forming part of the apparatus.

In particular, the circuit includes (FIG. 4) a control relay 72 which is in a subcircuit that extends between the two load lines 68 and 70 and further includes the switches 14 and 16 which are arranged in parallel. When the mixing tank 2 is full, both of the switches 14 and 16 are open. However, when the level of the fountain solution drops below the high water switch 16, that switch closes. This, however, does not energize the control relay 72, because the relay 72 has a normally open contact 72-1 located in series with the high water switch 16. Like, the high water switch 16, the low water switch 14 is designed to close when the level of solution in the tank 2 falls below it. Thus, when the tank 2 has completely drained, both switches 14 and 16 will be closed. The low water switch 14 places the control relay 72 across the lines 68 and 70 when it closes, and this in turn closes the contacts 72-1. Since the high water switch 16 is at this time closed, the contacts 72-1 remain closed after the low water switch 14 again opens as will occur with the introduction of more water into the tank 2, the current for energizing the relay 72 being directed through the switch 16 and contacts 72-1. Indeed, the relay 72 remains energized until the high water switch 16 again opens, which is when the tank 2 is completely filled. In short, the switches 14 and 16 together with the contacts 72-1 convert the control relay 72 into a latching relay which remains energized while the fountain solution is replenished, but de-energized as the fountain solution is withdrawn from the tank 2.

The control relay 72 has another set of contacts 72-2 which is in series with the solenoid valve 22 that admits water to the tank 2 and also with each of the four solenoid valves 32 which are located at the additive containers 28. Indeed, the solenoids of the valves 22 and 32 are arranged in parallel, this parallel group being in series with the set of contacts 72-2. Thus, all of the valves 22 and 32 open once the level of the solution reaches the low water switch 14, and as a result water flows from the supply pipe 20 into the tank 2 and additives are discharged into this water from the measuring containers 28. The contacts 72-2 open when the level of the water reaches the high water switch 16, for then the relay 72 is de-energized. This of course closes all of the valves 22 and 32.

In addition, the control relay 72 has a set of normally closed contacts 72-3 which are located in series with the pump 62 that draws the solution from the mixing tank 2 and directs it through the distribution line 66 to the circulating tanks of the presses. The pump 62 contains it own control circuitry which is responsive to the pressure within the pressure tank 64 and, in effect, energizes the pump 62 to maintain the pressure in that tank 64 generally constant. Since the contacts 72-3 are normally closed, the pump 62 will only operate after the control relay 72 is de-energized which occurs during the interval between the closing of the high water switch 16 and the closing of the low water switch 14. In short, the pump 62 withdraws solution from the tank 2, but cannot operate while the tank 2 is being replenished with water from the supply pipe 20 and with additives from the containers 28.

The control relay 72 has still another set of contacts 72-4 which are normally open and are located in series with the motor 6 that turns the mixing blades 8 within the tank 2, so that the motor 6 operates for as long as the relay 72 remains energized, which is while the tank 2 is filling with water. Actually, the set of contacts 72-4 is located in parallel with a switch 74 that is controlled by a timer 76, the latter being across the lines 68, 70 so that it operates continuously. The timer 76 is designed to close its switch 74 for about 20 seconds during every two minute interval, and thus causes the mixing blades 8 to turn and stir the fountain solution in the mixing tank 2 while it drains from the tank 2, which is of course during the interval that the control relay 72 is de-energized.

The control relay 72 has another set of contacts 72-5 which is normally closed and is located across the lines 68 and 70 in series with each of the float switches 42 for the measuring containers 28, those switches in turn being arranged in parallel. Moreover, the switch 42*a* is in series with an additive control relay 78*a;* the switch 42*b* is in series with a control relay 78*b;* the switch 42*c* is in series with a control relay 78*c;* and the switch 42*d* is in series with a control relay 78*d*. Thus, as the mixing tank 2 drains, which is during interval when the solenoid valves 32 are closed, the contacts 72-5 will be closed and the additive relays 78 will remain energized for as long as their respective float switches 42 are closed. Of course, when the mixing tank 2 is filling with water, that is in the interval between the time when the low water switch 14 opens and the time when the high water switch 16 opens, the contacts 72-5 are open and as a consequence none of the relays 78 may be energized at that time. Indeed, each relay 78 will energize only when two conditions exist, that is (1) when the main tank 2 is full and (2) when the level of the additive in its measuring container 28 is below the float switch 42 for that measuring container 28, for only then are both the contacts 72-5 and the float switch 42 closed.

The additive relays 78 control the pumps 48 which withdraw the additives from the several drums B, for each has set of contacts 78-1 which is in series with one of the pumps 48. For example, the relay 78*a* has normally open contacts 78*a*-1 which are in series with the pump 48*a*, and thus the pump 48*a* will operate only when the contacts 76*a*-1 are closed. The relays 76*b, c, d* are provided with like contacts 76*b*-1, *c*-1, *d*1, which are in series with the pumps 48*b, c, d,* respectively. Should the level of additive in any measuring container 28 be below the float switch 42 for that container during the interval that the main tank 2 is draining, the control relay 78 associated with that container 28 will be energized, and it, in turn, will cause the pump 48 that supplies the container 28 to likewise be energized. The pump 48 will of course introduce more additive into the container 28, drawing it from the particular drum B for that container 28. Once the additive reaches the level of the float switch 42, the pump 48 stops.

Each of the float switches 54 on the probes 52 for the barrels B is in series with a drum control relay 80, there being relays 80*a, b, c, d* for the switches 54*a, b, c, d,* respectively. Each relay 80 has one set of contacts 80-1 located in series with a warning light 82 that is on the control box 67, so that when the float switch 54 for that drum B closes, as the result of the additive having dropped below it, the light 82 is energized to signal a low drum B. Each drum relay 80 has another set of contacts 80-2 located in series with another and larger alarm light 84 and also in series with an alarm horn 86, the four sets of contacts 80 *a*-2, *b*-2, *c*-2, *d*-2, themselves being arranged in parallel. The alarm light 84 is also on the control box 67.

OPERATION

In use, the mixing apparatus A supplies fountain solution to the circulating tanks of several lithographic printing presses. In this regard, the circulating tank of each press has a mechanical float-type valve which is connected to the distribution line from the pressure tank 64 at the pump 62. Whenever the supply of fountain solution in a circulating tank drops below the level to which the mechanical valve for that tank is adjusted, the valve opens and more fountain solution will flow into the circulating tank, provided of course that the pressure within the pressure tank 64 is enough to force fountain solution through the discharge line 66 to the circulating tanks. This in turn usually requires that the pump 62 be capable of maintaining the pressure within the pressure tank 64, and that occurs only after the fountain solution has been mixed and is above the low water float switch 14 in the mixing tank 2.

Assuming that the mixing tank 2 is completely full, then both the low and high water float switches 14 and 16 will be open and the control relay 72 will be de-energized. When the relay 72 is in that condition, its contacts 72-3 are closed and the main pump 62 is placed across the load lines 68 and 70. As a consequence, the pump 62 will draw fountain solution from the mixing tank 2 and pump it into the pressure tank 64 to maintain the pressure within that tank substantially constant. Also, the contacts 72-5 are closed, but if the measuring containers 28 are filled with the proper amount of additives, then the float switches 42 will be open. On the other hand, if any one of the measuring containers 28 does not contain sufficient additive, as will be the condition immediately after the high water float switch 16 for the mixing tank 2 opens, then the float switch 42 for that container 28 will be closed and the relay 78 associated with it will be energized. The relay 78, when energized, has its contacts 78-1 closed and at those contacts complete a circuit through the additive pump 48 that is in series with the contacts 78-1. Indeed, the contacts 78-1 remain closed until the pump 48 supplies enough additive to the measuring container 28 to elevate the level of the additive to the float switch 42. At that time the float switch 42 opens and de-energizes the relay 78 associated with it, which in turn de-energizes the pump 48. The additives are held in the measuring containers 28 by the solenoid valves 32 which remain closed by reason of the fact that the sets of contacts 72-2 which are in series with those valves are open when the primary control relay 72 is de-energized.

The pump 62 upon being energized draws enough fountain solution from the mixing tank 2 to drop the level of the solution below the high water float switch 16, and as a consequence, the float switch 16 closes. This, however, does not energize the primary relay 72, since the normally open contacts 72-1 of that relay are in series with the switch 16 and the relay 72 and thereby prevent the flow of electrical current through the relay 72.

As the fountain solution drains from the mixing tank 2 the timer 76 periodically closes the timer switch 74 for short intervals of time, and during these intervals the motor 6 is energized and turns the mixing blades 8. The rotating blades 8 circulate the fountain solution within the tank 2, ensuring that any additives in suspension do not precipitate.

When the level of the fountain solution in the mixing tank 2 reaches the low water float switch 14, that switch closes and energizes the relay 72 which in turn changes the condition of its contacts 72-1, -2, -3, -4, and -5, and places the mixing apparatus A in condition for replenishment of the fountain solution. In particular, the contacts 72-3 open so that the pump 62 will not operate. The contacts 72-2, on the other hand, close, thereby opening the solenoid valves 22 and 32. The valve 22 admits fresh water to the tank 2 through the supply pipe 20, whereas the valves 32, upon opening, allow the additives from their respective measuring containers 28 to drain into the mixing tank 2. Thus, water and additives enter the mixing tank 2 at the same time, but the mixing tank 2 receives a full supply of additives before much Of the water is introduced. The contacts 72-5, which control the additive pumps 48 open, so that the pumps 48 are not energized while the additives drain from the measuring containers 28. The contacts 72-4 close and thereby energize the motor 6 for the mixing blades 8, and those blades mix the additives with the water that flows into the tank 2 from the supply pipe 20. Finally, the contacts 72-1, which are in series with the high water float switch 16, close. Thus, the solenoid 72 remains energized through the contacts 72-1 and high water float switch 16 after the level of the water rises above the low water switch 14 and opens that switch. Indeed, the water continues to rise until the high water switch 16 is again opened, and when that occurs the circuit through the primary control relay 72 is broken and the relay 72 is de-energized.

Of course, once the primary relay 72 is de-energized as a result of the solution reaching the high water switch 16, the various contacts of that relay change condition and convert the apparatus A to its drain cycle.

Should the level of the additive in any of the drums B fall below the float switch 54 on the probe 52 for that drum B, the float switch 54 will close and energize the relay 80 associated with it. That relay will in turn close its contacts 80-1 and 80-2. The contacts 80-1 energize the alarm light 82 that is specific to the particular drum B, whereas the contacts 80-2 energize the general alarm horn 86 and alarm light 84 to signal an attendant that one of the drums B is near depletion. In this regard, the probe 52 on which the switch 54 is carried is set high enough that the signal occurs well before the drum B is totally depleted, and indeed, the float switch 54 is high enough to permit a full charge of additive to be delivered to the measuring container 28 connected with that particular barrel B even after the alarm.

This invention is intended to cover all changes and modifications of the example of the invention herein chosen for purposes of the disclosure which do not constitute departures from the spirit and scope of the invention.

What is claimed is:

1. An apparatus for preparing a fountain solution for lithographic printing presses by mixing water with liquid additives derived from additive containers, said apparatus comprising: a mixing tank; a water supply line directed into the tank; a remotely operated water valve in the water supply line; a measuring container for each additive; additive supply means for directing additive from each additive container into its measuring container; an additive sensor at each additive container for determining when the additive container has a predetermined quantity of additive in it; additive release means for introducing the additive from each measuring container into the mixing tank; discharge means for withdrawing mixed fountain solution from the mixing tank; and control means to which the remotely operated water valve, the additive supply means, the additive sensors, the additive release means, and the discharge means are responsive, the control means including high and low sensors for detecting when the mixing tank is substantially empty and substantially full, respectively, the control means when the high sensor detects that the mixing tank is full causing the additive supply means to introduce an additive into each measuring container until the additive sensor for that measuring container detects that the container has a predetermined quantity of additive in it, the control means allowing the discharge means to withdraw solution from the tank as the level of the solution in the tank drops from the high sensor to the low sensor and preventing the discharge means from further withdrawing solution from the tank when the level of the solution reaches the low sensor, the control means further holding the water valve open and causing the additive release means to introduce a predetermined quantity of additive simultaneously from each of the measuring containers into the tank after the level of the solution reaches the low level sensor, whereby the water and additives are mixed within the tank to form more fountain solution, the control means further closing the water valve and preventing the additive release means from introducing additive into the tank when the level of solution reaches the high sensor.

2. An apparatus according to claim 1 wherein the additive supply means for each measuring container includes a supply line leading from the additive container to the measuring container, and a pump in the line; and wherein the additive sensor for the measuring container causes the pump to be de-energized when the volume of the additive within the measuring container reaches the prescribed measured quantity for that container.

3. An apparatus according to claim 1 and further comprising means for sensing the level of additive in each additive container and for producing a signal when the level of additive in any additive container is low.

4. An apparatus according to claim 1 and further comprising mean for stirring the water and additives continuously as the water flows into the mixing tank from the water supply pipe and for stirring the solution intermittently as the discharge means withdraws solution from the tank.

5. An apparatus according to claim 1 wherein the discharge means comprises a pump that draws solution from the bottom of the mixing tank.

6. An apparatus according to claim 5 wherein the discharge means further includes a pressure tank to which the pump delivers the solution and a distribution line leading from the tank, the pressure tank being arranged such with respect to the pump that the pressure of the solution within it and within the distribution line remains substantially constant.

7. An apparatus according to claim 1, wherein the measuring containers and release means are located at an elevation higher than the level of solution in the tank when that level is at the high sensor.

8. An apparatus according to clam 7 wherein the release means comprises an electrically operated valve at the bottom of each measuring container, each valve being closed when not energized so as to hold additive in its container, each electrically operated valve when energized opening to allow additive to flow from its measuring container into the mixing tank, the electrically operated valves being operated by the control means.

9. An apparatus according to claim 7 wherein the high and low sensor are electrical switches that are arranged in parallel and are open when the level of solution exceeds the level to which they are set in the tank, the water valve is electrically operated, and the control means further includes a relay located in series with the parallel arrangement of switches and has a first set of contacts which are in series with the switch of the high sensor and close when the relay is energized and a second set of switches which are arranged in series with the electrically operated valves of the additive release means and also in series with the electrically operated water valve, so that the relay is energized when the switch of the low sensor closes and remains energized until the switch of the high sensor opens, whereby the water valve and the valves of the additive release means are open as the mixing tank fills the water.

10. In combination with several lithographic printing presses, each having a fountain for supplying a fountain solution to its ink train and a circulating tank through which the fountain solution is circulated, an apparatus for mixing the fountain solution and for delivering it to the circulating tanks of the presses, said apparatus comprising: a mixing tank; high and low sensors for detecting the level of fountain solution in the mixing tank; a pump unit for withdrawing fountain solution from the bottom of the mixing tank; a distribution line leading from the pump unit to the circulating tanks of the presses for directing the fountain solution to the circulating tank; additive measuring containers; an additive sensor in each measuring container for detecting when the additive within the measuring container reaches a prescribed level; additive supply means for directing additive into each measuring container; release means for discharging the additive held in each measuring container into the mixing tank; a water supply line connected to a source of water and being directed into the tank; a valve in the water supply line for allowing water to flow from the water supply line into the tank when opened; and control means for preventing the pumping unit from operating and for opening the water valve when the level of fountain solution in the tank reaches the level of the low sensor, whereby the tank fills with water, the control means further causing the release means to release the additives simultaneously from the measuring containers as the water flows into the tank from the supply line, so that the additive mixes with the water in the tank to form more fountain solution, the control means when the level of fountain solution reaches the high sensor also preventing the release means from discharging more additive into the tank and causing the additive supply means to introduce more additive into each measuring container until the additive sensor for the container detects that the additive for that container has reached the prescribed level.

11. The combination according to claim 10 wherein the measuring containers are located at an . elevation higher than the high water position sensed by the high level sensors of the control means and the additive supply means for directing a measured quantity of additive into each measuring container includes an electrically operated pump located between the container and the source of additive, the control means causing the pump to be de-energized when the additive reaches the level of the additive sensor for the tank.

12. The combination according to claim 11 wherein the release means comprises an electrically operated valve located below each measuring container for allowing additive to flow from the container when opened, and wherein the control means causes the valves of the release means to open when the level of the solution reaches the level of the low level sensor.

13. The combination according to claim 10 wherein the pump unit includes an electrically operated pump and a pressure tank connected between that pump and the distribution line such that the solution that is drawn from the mixing tank is first pumped into the pressure tank and then flows into the distribution line.

* * * * *